United States Patent [19]

Simpson

[11] 4,271,491

[45] Jun. 2, 1981

[54] INTRUDER ALARM SYSTEM

[76] Inventor: Ronald R. Simpson, 7062 Wolff, Westminster, Colo. 80030

[21] Appl. No.: 962,243

[22] Filed: Nov. 20, 1978

[51] Int. Cl.[3] ..... G08B 13/00

[52] U.S. Cl. ..... 367/136; 367/901

[58] Field of Search ..... 340/566, 16 R; 367/136, 367/901

[56] References Cited

U.S. PATENT DOCUMENTS

| | | | |
|---|---|---|---|
| 3,487,396 | 12/1969 | Perelman | 367/136 |
| 3,696,369 | 10/1972 | Laymon et al. | 367/136 |
| 3,710,336 | 1/1973 | Lerner | 340/566 X |
| 3,732,536 | 5/1973 | Larka et al. | 367/901 X |
| 3,745,552 | 7/1973 | Wilt | 340/566 X |
| 3,958,213 | 5/1976 | Scott et al. | 340/566 |

*Primary Examiner*—David L. Trafton

*Attorney, Agent, or Firm*—Max L. Wymore

[57] ABSTRACT

The present invention relates to an intruder alarm system which compensates for background and other interfering noises. The system comprises dual amplifiers, one a main channel and the other a control channel wherein the control channel is responsive primarily to background and other interfering noises and develops a control signal which when applied as a control signal to modify the amplification characteristics of the main amplifier effectively removes the effect of the background and other interfering noises from the output of the main channel.

3 Claims, 2 Drawing Figures

INTRUDER ALARM SYSTEM

BACKGROUND OF THE INVENTION

In intruder alarm systems in which acoustic or other frequencies are sensed as an indication of the presence and movement of an intruder within an area to be protected is accomplished by an electromechanical transducer which provides electrical signals which must be identified as being caused by an intruder. Often there are background noises usually of long duration or high amplitude or of a frequency that may give rise to false alarms and need to be compensated for.

SUMMARY OF INVENTION

The present invention is directed to an intruder alarm system which includes an electromechanical transducer providing electric signals in response to vibrations incident thereon, a first amplifier means to amplify the collective signals, second and third amplifier means for receiving and amplifying selected portions of the collective signals, said second amplifier means being responsive to and amplifying long and short term signals to produce a first output signal and the third amplifier means being responsive to long term signals to produce a second output signal, means responsive to the second output signal to render the second amplifier means relatively insensitive to long term signals such that the first output signal is representative substantially only of short term vibrations received by the transducer and alarm means responsive to said first output signal to indicate an alarm condition essentially only in response to receipt by the transducer of short term vibrations even in the presence of long term vibrations.

An intruder alarm system in accordance with the present invention will now be described by way of example with reference to the accompanying drawing.

DESCRIPTION OF THE PREFERRED EMBODIMENT

Figures 1, 2:
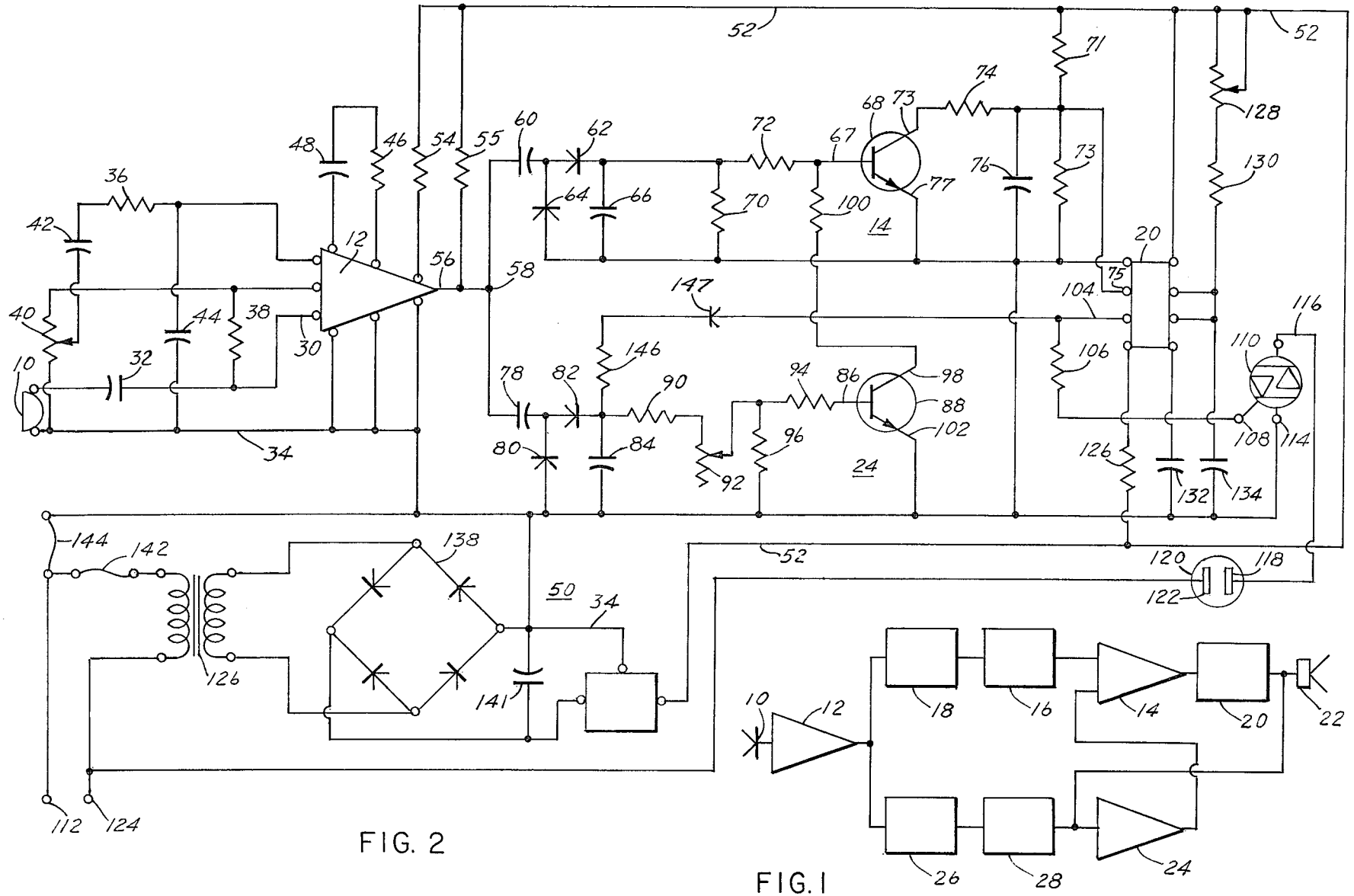
FIG. 1 is a block diagram of the system.
FIG. 2 shows the system schematically.

Referring to the figures, the intruder alarm system comprises at least one electromechanical transducer represented by reference numeral 10 which is arranged to provide electrical signals in response to mechanical or acoustical vibrations falling on the transducer. One or more of these transducers, also sometimes known as geophones, are attached to walls, ports or buried in the ground to cover the area to be protected by the alarm system. They may be connected individually or collectively to a broad band amplifier 12.

In response to footsteps or other causes of ground borne or acoustic vibrations within or near the area the transducers are positioned to protect, the transducers receive vibrations and produce representative signals over a wide range of frequencies and amplitudes. These signals are amplified by a first high gain amplifier 12 and include the broad spectrum of frequencies and amplitudes received by the transducer 10. The output from amplifier 12 is fed to a second amplifier means 14 after first being rectified or detected by rectifier 16 and filtered by filter 18. The output from amplifier means 14 is fed to a timer 20 which provides an output signal in response thereto to activate an alarm means 22 for a predetermined duration.

The output from the first amplifier 12 is also fed to a third amplifier means 24 after being rectified by rectifier 26 and filtered by filter 28. The output from the third amplifier means 24 is applied to the input circuit of amplifier means 14 to control the base bias thereof in a manner to provide an output from the second amplifying means representative of the difference signal between the outputs from second and third amplifying means 14 and 24. The output from timer means 20 is also fed to the input of third amplifier means. The timer 20 output once energized continues for the preset time interval and the signal from the timer lowers the bias on the second amplifier 14 via the third amplifier 24 to cut the second amplifier 14 off until the timer times out preventing any response to an incoming audio signal via transducer 10 until the timer shuts down.

Referring now to FIG. 2, the transducer 10 in the form of a high impedance crystal microphone has one output connected to an input 30 of a first amplifier 12 via capacitor 32. The other output of transducer 10 is connected to B− or ground potential of amplifier 12 via conductor 34. Resistors 36 and 38 along with potentiometer 40 and capacitors 42 and 44 are connected to provide a gain control for the transducer signals applied to amplifier 12. Resistor 46 in series with capacitor 48 provides compensation. The amplifier 12 is a linear integrated circuit having an ultra high gain wide band amplifier array forming three individual amplifiers. In this circuit, all three amplifiers are cascaded to give a gain of 120 DB over a frequency range of from 500 through 10 KHz. B+ voltage is supplied to the amplifier from a regulated twelve volt power source 50 via conductor 52 and resistor 54. The output 56 of amplifier 12 is split into two branches at 58 and fed into two channels of audio discrimination that tracks and levels the audio signals generated by the microphone transducer 10 and acts somewhat as an "Automatic Volume Control" (AVC) by means of the time factor and stores the past time or background signal level. Basically the so-called AVC unit tracks the sound to maintain a constant level as to minimum and maximum allowable signal and to the approach speed, frequency and amplitude of the sound.

The output signal from amplifier 12 is fed through capacitor 60, rectified by diodes 62 and 64 and filtered by capacitor 66 for delivery to the base electrode 67 of transistor amplifier 68 via resistor 72. Resistors 70 and 72 set the base bias of transistor 68 forming amplifier means 14. The output signal on the collector electrode 73 of transistor 68 is connected via resistor 74 to the input 75 of timer 20, the output signal being filtered by capacitor 76. The emitter electrode 77 is connected to B− or ground potential. Resistors 71 and 73 form a voltage divider to supply proper operating voltages to transistor 68.

The output signal from amplifier 12 is also fed through capacitor 78 and rectified by diodes 80 and 82 and filtered by capacitor 84 for delivery to the base electrode 86 of transistor amplifier 88 via resistor 90, rheostat 92 and resistor 94. Resistors 94 and 96 set the base bias of transistor 88 forming amplifier means 24. The output signal on the collector electrode 98 is connected to the base electrode 67 of transistor amplifier 68 via resistor 100 and the emitter electrode 102 of transistor 88 is connected to B− or ground potential.

An output signal appears on the output 104 of timer 20, which is operated in a monostable mode, when a potential is available from the collector 73 of transistor 68 to lower the voltage on the input 75 of timer 20 to zero volts. The output voltage on output 104 of timer 20 is applied via resistor 106 to the gate electrode 108 of Triac 110 to fire same and connect the ground potential side of the line voltage connection 112 to electrode 114 and electrode 116 thereof to one contact 118 of connector 120. The other contact 122 of connector 120 is connected to the other line voltage connection 124. Connections 112 and 124 are connected to an alternating line current source such as 110 volts, 60 cycle house current. Thus, an alarm output is present on the output 73 of transistor 68 which fires Triac 110 and connects a load connected to connector 120 to line voltage. This load may be an audible or a visual alarm or other means adapted to be actuated when so connected.

Power is supplied to the timer 20 from the 12 volt supply 50 via conductor 52 and resistor 126. A potentiometer 128 provides adjustable timing by supplying a selected potential from conductor 52 via resistor 130 to timer 20. Capacitors 132 and 134 provide filtering. The on-time of timer 20 may be readily varied from as little as one second to thirty minutes or longer, as desired.

The 12 volt regulated power supply 50 comprises a transformer 136 which transforms the line voltage applied at 112 and 124 to about 26 volts AC. This voltage is fed to a full wave rectifier bride 138, and the rectified output is fed to the input of a 12 volt voltage regulator via input conductor 140 and ground potential conductor 34 to provide a 12 volt supply voltage on conductor 52 filtered by capacitor 141. The transformer is fused as at 142 while the balance of the circuit is fused as at 144.

In operation, vibrations are picked up by microphone 10, amplified by first amplifier 12 and fed to second and third amplifiers 14 and 24. The signals to second amplifier are rectified by diodes 62 and 64 resulting in capacitor 66 being charged as a function of the signals received and having a relatively short term charge cycle. At the same time the amplified signal from the first amplifier 12 is fed to the second amplifier, it is also fed to the third amplifier 24. The signals to the third amplifier are rectified through diodes 80 and 82, then filtered and stored in capacitor 84 forming an R-C charging network with resistors 90, 92 and 93. This R-C circuit has a relatively long time constant and the amount of energy stored in capacitor 84 is a function of the length and time duration, amplitude and frequency of the signals picked up by microphone 10. Potentiometer 40 allows setting of the audio sensitivity and resistors 90, 92, 93 and 94 fires the base bias of amplifier 88. Resistor 92, being variable, sets the amount of audio discrimination as sensed by the electrical energy stored in capacitor 84. The output on collector 98 of amplifier 88 feeds through resistor 100 and further controls the base bias of amplifier 68 which provides a difference in signal output to appear on the collector 73 of amplifier 68 and thus remove the long term, slow rise time signals from affecting the output such that only those vibrations of relatively fast rise times may be selectively used as a means of detecting the presence of an intruder while signals associated with normal background vibrations will not generate an alarm signal. The values of capacitors 84 and 66 are of different values and are chosen such that the charge and discharge characteristics are responsive to the approach speed of an intruding object.

An alarm condition is seen to exist when the potential on input 75 of the timer 20 goes to zero volts. This produces an output on 104 of a duration depending on the adjustment of 128. This output will trigger Triac 110 via resistor 106 and gate 108 to effectively connect terminals 114 and 116 to complete a circuit through connector 120. At the same time the output on 104 is applied to capacitor 84 via resistor 146 to set the base bias of amplifier 68 to cutoff and prevent output signals from appearing on collector 73 thereof during the time out of timer 20. Thus, the time out period for the timer 20 can also be used as a further means of selecting preset conditions that will be indicative of and generate an alarm condition. A diode 147 between resistors 106 and 146 serves the dual function of protecting against a positive voltage from being applied to IC 20 and Triac 110.

Once the timer 20 has timed out, capacitor 84 will discharge at a slow rate to the point of normal operation and thus cannot reactivate amplifier 68 until capacitor 84 has reached a low or no energy capacitance discharge returning the circuit to normal tracking operation.

Representative component values for a preferred embodiment are as follows:

| Drawing Reference No. | |
|---|---|
| 10 | high impedance crystal microphone |
| 12 | linear integrated circuit - CA 3035 (RCA) |
| 20 | linear integrated circuit - MC 555 (Motorola) |
| 32 | 10 Mfd. |
| 36 | 2.2 KΩ |
| 38 | 220 KΩ |
| 40 | 5 K |
| 42 | .22 Mfd. |
| 44 | .05 Mfd. |
| 46 | 680Ω |
| 48 | .05 Mfd. |
| 54 | 1 KΩ |
| 55 | 4.7 KΩ |
| 60 | 10 Mfd. |
| 62 | IN914 |
| 64 | IN914 |
| 66 | 10 Mfd. |
| 68 | 2N2222 |
| 70 | 4.7 KΩ |
| 72 | 47 KΩ |
| 74 | 47 KΩ |
| 76 | .01 Mfd. |
| 78 | 10 Mfd. |
| 80 | IN914 |
| 82 | IN914 |
| 84 | 47 Mfd. |
| 88 | 2N2222 |
| 90 | 22 KΩ |
| 92 | 50 KΩ |
| 94 | 10 KΩ |
| 96 | 47 KΩ |
| 100 | 4.7 KΩ |
| 106 | 220 |
| 110 | Triac |
| 120 | 110 volt receptacle |
| 126 | 1 KΩ |
| 128 | 1 MΩ |
| 130 | 1 KΩ |
| 132 | .01 Mfd. |
| 134 | 1 K Mfd. |
| 136 | Primary 117 VAC<br>Secondary 26 VAC @ 300 mA |
| 138 | 1A - 50 VDC |
| 141 | 470 Mfd. |
| 147 | IN914 |

Having described and disclosed what is believed to be the preferred embodiments of my invention, it will be apparent to those skilled in the art that numerous alterations, omissions, and additions may be made without departing from the spirit thereof.

What is claimed is:

1. In an intruder alarm system which comprises at least one electromechanical transducer means providing electrical signals in response to vibrations incident on said transducer, first amplifier means having an input and an output connected to receive and amplify signals from the transducer, first detection and storage means responsive to relatively short term signals connected to the output of the first amplifier means and to the input of a second amplifier means having an output, a second detection and storage means responsive to relatively long term signals connected to the output of the first amplifier means and to the input of a third amplifier means having an output connected to alter the signal response of said second amplifier means to effectively subtract the relatively long term signals from the output of said second amplifier means and alarm means connected to said output of said second amplifier means and responsive to the relatively short term signal output to indicate an alarm condition.

2. A method of detecting the presence of relatively short term vibrations produced by an intruder within a security area in the presence of relatively long term vibrations which comprises the steps of:

converting the vibrations into electrical signals;

amplifying the electrical signals;

detecting the signals to provide a first output signal representative of the short term vibrations present and amplifying said first output signals;

detecting the signals to provide a second output signal representative of the long term vibrations present;

modifying the parameters of amplification of said first output signals as a function of the second output signal to essentially subtract the second output signal from said first output signal; and, generate an alarm signal as a function of the first output signal.

3. An intruder alarm system which comprises at least one electro-mechanical transducer means providing electrical signals in response to vibrations incident on said transducer, first amplitude modulation detection and signal storage means connected to receive and detect amplitude modulated signals from the transducer and supply same to an amplifier means to provide an output signal, second amplitude modulation detection and signal storage means connected to receive and detect those signals from the transducer having predetermined time period, frequency and amplitude, to provide control signals applying the control signals to control the amplification characteristics of the amplifier to effectively subtract the control signals having predetermined amplitude from the output signals from said amplifier and means responsive to said output signals to indicate an alarm.

* * * * *